US005664539A

United States Patent [19]

Vieira

[11] Patent Number: 5,664,539

[45] Date of Patent: Sep. 9, 1997

[54] LINEAR ACTUATOR FAIL-SAFE REMOTE CONTROL

[76] Inventor: John Vieira, P.O. Box 146, Glade Park, Colo. 81523

[21] Appl. No.: 606,608

[22] Filed: Feb. 26, 1996

[51] Int. Cl.[6] ..... F02B 77/00; F02D 7/00

[52] U.S. Cl. ..... 123/198 DB; 123/386; 123/396

[58] Field of Search ..... 123/198 D, 198 DB, 123/372, 357, 365, 396, 386

[56] References Cited

U.S. PATENT DOCUMENTS

| | | | |
|---|---|---|---|
| 2,879,754 | 3/1959 | Kienlin | 123/386 |
| 4,092,965 | 6/1978 | Lintott | 123/386 |
| 4,329,954 | 5/1982 | Dobbs | 123/198 DB |
| 4,351,293 | 9/1982 | Hewitt | 123/198 DB |
| 4,387,679 | 6/1983 | Folger | 123/386 |
| 4,757,791 | 7/1988 | Hachitani | 123/357 |
| 4,785,778 | 11/1988 | Gibson | 123/365 |
| 4,957,080 | 9/1990 | Howland | 123/386 |
| 5,154,150 | 10/1992 | Vieira | 123/396 |
| 5,255,651 | 10/1993 | Wakasa | 123/357 |
| 5,291,867 | 3/1994 | Hummel | 123/372 |

*Primary Examiner*—Carl S. Miller

[57] ABSTRACT

An inherently fail-safe automatic remote-control and engine protection device of electromechanical/hydraulic assembly is supplied by engine lube oil and controlled by circuitry, acting on an existing non-included throttle or governor, especially in diesel generator standby applications, so as to enhance utility, engine reliability and longevity, all without engine modification. This assembly is a linear actuator, of few parts and no levers, basically comprised of a pull solenoid and a spring-return hydraulic cylinder contained within a guide tube which is held stationary. The solenoid armature is indirectly attached to one end of a cable and the engine governor is linked to the other end. The hydraulic cylinder's rod is rigidly attached to an actuator tube which is a sliding sleeve to the guide tube. The actuator tube itself is coupled to the cable such as to allow independent operation of said cable by solenoid, cylinder, or both.

3 Claims, 1 Drawing Sheet

LINEAR ACTUATOR FAIL-SAFE REMOTE CONTROL

BACKGROUND OF INVENTION

1. Field

The instant invention relates to the remote control, load-switching, protection and enhancement of utility, reliability and longevity of application of the internal combustion engine, more especially as to diesel generator standby use, by means of an attachment enabling automatic judicious full-range throttle control to an existing, non-included governor or throttle.

2. Prior Art

Previous apparatus realized one or more of above cited objectives, but to the best of inventor's knowledge, only inventor's prior U.S. Pat. No. 5,154,150 provides all of the above in a simple, inexpensive and easily applied device.

3. Inventor's Prior Invention

U.S. Pat. No. 5,154,150 was conceived to, and does, combine the capabilities of automatic: remote-controlled start/stop, adjustable proportional warm-up/cool-down time dependent upon engine/ambient temperature, variable throttle advance rate, load-switching, fail-safe engine fault shutdown, and idle/off standby select. It does so by controlling an engine's throttle, or governor, and relies upon the principles and characteristics of:

(1) a spring-return fluid actuator supplied by an engine's pressurized lube oil system, (2) oil viscosity is proportional to engine/ambient temperature.

Said prior invention, basically, utilizes a pivoted hydraulic cylinder acting upon levers, pivots, and a rod to control an engine's throttle position over its full range in response to applied engine oil pressure and sensed fault conditions.

4. Prior Invention's Drawbacks

Though said prior invention achieved its objectives and proved to be reliable, mobile use was less than ideal. In some applications, installation required an elaborate bracket to assure proper orientation to throttle. Additionally, levers, pivots and rod exposed to engine vibrations and contaminants are deemed to be drawbacks. The addition of a cable and an enclosure would have overcome most cited objections, but not all.

5. Instant Invention's Objectives and Advantages

To provide a new machine, more universal in application, which improves upon inventor's prior U.S. Pat. No. 5,154,150 by accomplishing all objectives of prior device, but better suited to mobile use; without any levers or pivots; more efficient pull solenoid rather than push type; moving parts greatly reduced in number and better protected from adverse forces. The device is to be mounted without concern for orientation, remote to throttle, on or close to engine/generator as apropos to the application.

The solution to the problem required in part, an inexpensive means of attaining a smooth linear motion from a combination of hydraulic actuator and efficient electrical solenoid. The specially constructed solenoid armature, linkage system and cable in combination was the answer. Said answer rises to the definition of "invention" since same would not be obvious to a person of ordinary skill in the state of the art.

Having been reduced to practice, instant invention has achieved all, including automation, remote control and the ability to be completely isolated from vibration and its ill effects.

All references cited in inventor's U.S. Pat. No. 5,154,150 disclosed mechanical, hydraulic, and/or pneumatically operated devices devoid of electrical control means. As such, they are also overcome by instant invention on same grounds cited in inventor's prior patent, and here as being incapable of remote control.

SUMMARY OF THE INVENTION

The instant device is a linear-acting improved inherently fail-safe remote control/engine protection electromechanical/fluid actuator for automatic engine governor or throttle control by remote signal and engine fault sensors. It is comprised of a stationary pull solenoid and stationary fluid actuator within a tube, arranged to act upon a cable so as to control throttle movement automatically in response to a flow-control check valve, solenoid valve, fault and control switch mode signals.

Principles of Operation

The basic principles of inherent fail-safe and reliable operation to be derived from a fluid actuator supplied by engine oil under pressure; and temperature dependent oil viscosity as affecting throttle advance and warmup time, when applied to a fluid actuator through a controlled check-valve have been retained here as in inventor's prior U.S. Pat. No. 5,154,150.

Application of Principles

Rather than utilizing a push solenoid, pivoted fluid actuator, levers and pivots, as in inventor's prior cited patent, the instant invention makes use of a specially constructed stationary pull solenoid and a stationary fluid actuator mounted within a sliding tube. Upon a start signal, the solenoid pulls a cable, attached to the engine throttle, to an idle position. The fluid actuator fills from the engine lube oil system, pulling the cable, and thus throttle control is passed from the solenoid to the fluid actuator by arrangement of a sliding tube, solenoid, cable and fluid actuator. A solenoid valve and controlled check-valve are utilized and arranged such as to control operation of the fluid actuator.

Installation

The cable is coupled to the engine's governor or throttle. The linear actuator unit, solenoid valve and controlled check-valve are mounted, oil supply tubing connected, fault switches attached and controls applied.

PREFERRED EMBODIMENT

Figure 2:
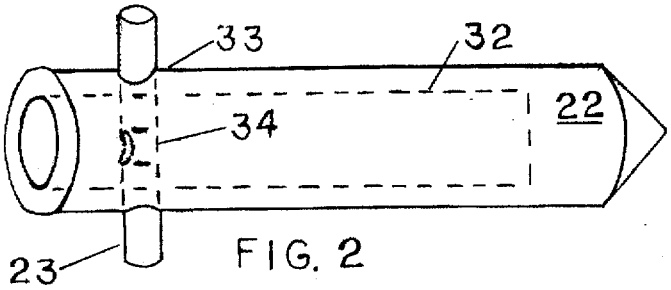
FIG. 2 is an enlarged view, showing details, of the armature (22) of the idle solenoid (5) of FIG. 1.

The instant invention is shown and described herein as to configuration and embodiment considered most practical and preferred. Still, one skilled in the art may easily make modifications which are a departure from that shown but not avoid remaining within the scope of the instant disclosure.

The instant invention is best understood by referring to the drawings and the following description of preferred embodiment. The device is shown as an add-on to an existing engine with a governor, as a linear actuator built around a throttle cable attachment for an engine governor and so arranged as to impart movement and control to said governor for purpose of achieving automatic full-range throttle control in response to control and fault signals.

Elements of the Invention mount (1) retaining and mounting means: to hold apparatus stationary guide tube (2): a means for guiding a movable actuator member of over a range of movement in one plane, and also as a means of restraining a solenoid and fluid actuator actuator tube (3) fluid actuator to orientation and attachment means coupling means: sliding sleeve to guide tube, enables hydraulic cylinder rod to control cable spring-return hydraulic cylinder (4) fluid actuator means with included spring (30) a stored energy means idle solenoid (5) electrical to mechanical motion transducer means: pulls cable to idle position throttle cable (6) orientation and attachment means controlled check valve (7) fluid pressure switched fluid paths means: adjustable restricted flow in one direction, unrestricted flow in opposite direction. Operated by engine oil pressure solenoid valve (8) electrically switched fluid paths means: main control for hydraulic cylinder fluid flow load switch (9) sensor means: for detection and feedback signal of one of, proper throttle position, engine speed, generator frequency. May be a simple mechanically operated switch, magnetically operated switch, transducer or electronic speed, position, or frequency sensor.

CONSTRUCTION

A mount (1) is formed such as to hold a guide tube (2) between two uprights. The guide tube (2) is restrained from movement by groove (10)s in mount (1) uprights and pressure exerted by tie rod (11) tending to force said uprights together. Idle solenoid (5) is restrained in position by circumferential crimp (12) of guide robe (2) and base of spring-return hydraulic cylinder (14). Idle solenoid (5) electrical leads exit interior of guide tube (2) by way of clearance hold (13). Spring-return hydraulic cylinder (4) is retained in place within guide tube (2) by tubing adapter (14) passing through interference hole (15) into spring-return hydraulic cylinder (4) port. Actuator tube (3) is a loose shorter sleeve to guide tube (2) and is made to slide along guide tube (2) by interference fit drive pin (16) being driven by extension of spring-return hydraulic cylinder (4) rod (17) which is also an interference fit to drive pin (16). Drive slot (19)s in guide tube (2) are rectangles of sufficient width and length to allow non-binding full travel of drive pin (16). Clearance slot (18) is sufficiently long and wide to allow actuator tube (3) to clear both idle solenoid (5) leads and spring-return hydraulic cylinder (4) tubing adapter (14) in actuator tube (3) traverse from full retract to full extend positions. Driven pin (20) is an interference fit through actuator tube (3) and is clearance drilled at center to receive cable (6) loosely. Driven slot (21)s in guide robe (2) are rectangles sufficiently long and wide as to allow non-binding full travel of driven pin (20). Both the drive slot (19)s and driven slot (21)s are located on the diameter on both sides of guide tube (2). Idle solenoid (5) armature (22) contains armature pin (23) by arrangement of armature pin interference hole (33) and pulls on the cable (6) when energized by virtue of armature pin (23) contacting and exerting force upon cable end (24). Clearance hole (40) is drilled across the center of driven pin (20)'s long axis so as to allow for loose fit and travel of cable (6). Armature pin (23) is also drilled across the center of its long axis to form cable clearance hole (34) for loose fit of cable (6). Armature (22) is clearance drilled along its longitudinal axis, for sufficient length to form cable over travel bore (32) for non-binding cable end (24) travel. Cable stop (25) is an increased girth on cable (6) located so as to allow drive pin (20) to move cable (6) forward and prohibit cable (6) retreat beyond position determined by traveling actuator tube (3). Controlled check valve (7) is threaded at included inlet port (35) for connection to engine lube oil under pressure. Oil flow into the device is indicated by arrow C of FIG. 1. Included outlet port (36) of controlled check valve (7) is connected to in port (37) of solenoid valve (8). Controlled check valve (7) contains an adjustable orifice in restricted forward flow path from inlet port (35) to outlet port (36). Reverse full flow path from outlet port (36) to inlet port (35) is blocked by included one-way valve whenever higher pressure is present at inlet port (35) than at outlet port (36). A higher pressure at outlet port (36) than at inlet port (35) will cause one-way valve to release thereby connecting reverse full flow path between outlet port (36) and inlet port (35). Solenoid valve (8) is a 3-way normally closed type with included in port (37) connected to controlled check valve (7) outlet port (36). Solenoid valve (8) included out port (38) is connected to spring-return hydraulic cylinder (4) tubing adapter (14) by tubing (26). Solenoid valve (8) included drain port (39) is connected by tubing (26) to drain (27) which is threaded for connection to engine oil sump. Arrow D of FIG. 1 indicates oil drain direction. Construction of solenoid valve (8) is such that with no electrical signal applied, included out port (38) is connected to included drain port (39). With electrical signal applied, included in port (37) is connected to included out port (38) enabling oil flow into tubing (26), through tubing adaptor (14) into spring-return hydraulic cylinder (4). Load switch (9) sensor means is a magnetically operated electrical switch attached to mount (1) and positioned so as to be actuated by magnet (28) at extended position of spring-return hydraulic cylinder (4) rod (17) corresponding to preselected load-connect engine speed, and provide a feedback signal for same. Said position of extension of spring-return hydraulic cylinder (4) rod (17) is limited by adjustable throttle stop (29). Compression spring (30) within spring-return hydraulic cylinder (4) bears against said cylinder's piston (31) and is compressed by oil pressure against the opposite side of said piston (31), during extension mode of said spring-return hydraulic cylinder (4). Upon loss of oil pressure against said piston (31), stored energy of spring (30) compels retraction of piston (31), within spring-return hydraulic cylinder (4) bore, with its attached rod (17).

Operation

In "off" standby mode: wired or wireless remote (or local) start/on button is pressed. Circuitry control causes starter to crank and idle solenoid (5) is energized, pulling in idle solenoid (5) armature (22) and thereby causing armature pin (23) to drive throttle cable (6) by force against cable end (24) and advancing the engine's throttle to start position in the direction indicated by arrow B of FIG. 1. Concurrently, circuitry powers solenoid valve (8) allowing pressurized engine lube oil to begin flowing through tubing (26) from controlled check valve (7) in the restricted forward flow direction, as indicated by arrow C of FIG. 1, through solenoid valve (8) in port ((37) to out port (38) path and into spring-return hydraulic cylinder (4) by way of tubing adapter (14). When the engine does start, if oil pressure is not above the oil sensor threshold, idle solenoid (5) is de-energized, causing armature (22) to retract, releasing force on the throttle cable (6) resulting in the engine's throttle assuming the off position. The engine stops. If instead, engine oil pressure is above threshold when the engine starts, the engine will run at timed idle since idle solenoid (5) will remain energized until the time period expires as determined by the circuitry timer. If spring-return hydraulic cylinder (4) rod (17) does not extend and advance actuator tube (3) prior to idle solenoid (5) being de-energized, the engine stops. If spring-return hydraulic cylinder (4) does receive sufficient oil to advance rod (17) prior to idle solenoid (5) being de-energized, drive pin (16) in rod (17) will carry actuator tube (3) forward in the direction indicated by FIG. 1 arrow A causing driven pin (20) to contact cable stop (25). Thus, throttle cable (6) is prevented from retracting below idle position and is further advanced gradually toward the position corresponding to engine operating speed (which in application is determined by load type), as set by throttle stop (29), as spring-return hydraulic cylinder (4) fills up and compresses spring (30). As driven pin (20) advances, throttle cable (6) is driven into cable overtravel bore (32) of armature (22) by way of cable clearance hole (34) in armature pin (23). Just prior to the engine's operating speed position being reached by extension of rod (17), the magnetic field of magnet (28) actuated load switch (9) attached to mount (1) and thereby, an electrical load is switched on by circuitry control.

If oil pressure loss or other fault is sensed at any time while the engine is running, circuitry will disconnect the load and de-energize solenoid valve (8). Solenoid valve (8) in port (37) to out port (38) path is blocked and out port (38) to included drain port (39) path is connected. Spring-return hydraulic cylinder (4) compressed spring (30) now causes spring-return hydraulic cylinder (4) to begin emptying through tubing adapter (14) into solenoid valve (8) and ultimately out through drain port (39) into the engine's sump by way of drain (27) in the direction indicated by FIG. 1 arrow D. Rod (17) retracts. Drive pin (16) pulls actuator tube (3) in retract direction again at the direction of arrow A of FIG. 1. Driven pin (20) releases force on cable stop (25) allowing throttle cable (6) to retract against the direction indicated by arrow B of FIG. 1, away from the closed end of cable overtravel bore (32) of armature (22). Complete retraction of spring-return hydraulic cylinder (4) compels driven pin (20) to assume throttle off position and the throttle cable (6) will continue to retract until cable stop (25) is restrained by contact with armature pin (22). Throttle cable (6) is now in the off position, the engine throttle stops fuel flow and the engine stops.

Figure 1:
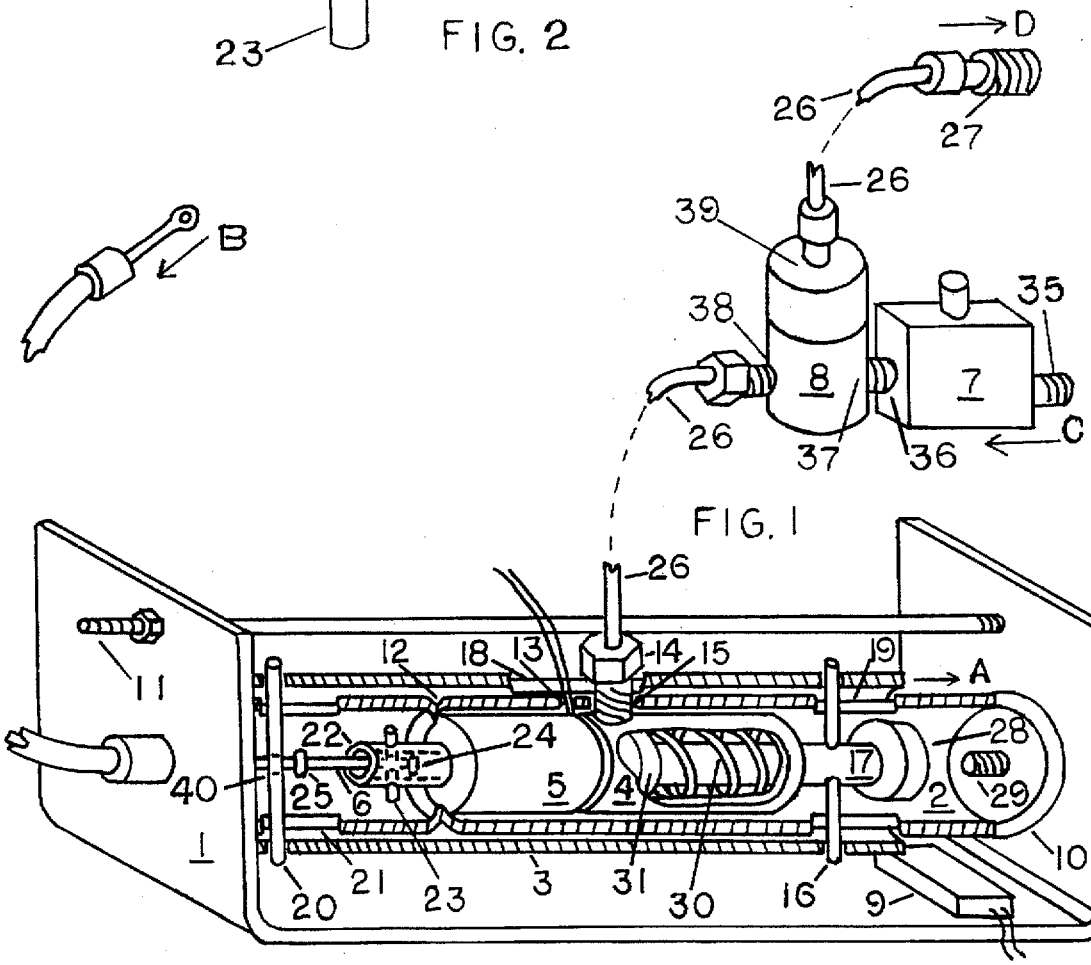
FIG. 1 is a perspective view of one embodiment of device in standby position showing guide and actuator tubes in longitudinal section and hydraulic cylinder in partial cut-away disclosing return spring provider of stored energy.

If engine oil pressure fails but is not sensed due to a faulty oil sensor circuit component, solenoid valve (8) may not de-energize but a fail-safe attribute of this device causes spring-return hydraulic cylinder (4) to drain in the reverse direction through out port (38) to in port (37) path of solenoid valve (8), then through the released check-valve of full reverse flow path of controlled check-valve (7) into the engine against the direction indicated by arrow C of FIG. 1. The stored energy of spring (30) causes rod (17) to retract carrying magnet (28) away from, and de-energizing, load switch (9). Associated circuitry disconnects the load and the engine stops as force on throttle cable (6) is released by same mechanism and events as for sensed engine oil pressure failure.

When a normal stop signal is received, the load is disconnected, idle solenoid (5) is energized and solenoid valve (8) is de-energized. Spring-return hydraulic cylinder (4) drains through the same path as in the sensed fault mode and throttle cable (6) is released as described for spring-return hydraulic cylinder (4) in retraction mode, except that armature (22) of idle solenoid (5) holds throttle cable (6) in the idle position as described for start-up. The engine idles for a preset time, then idle solenoid (5) is de-energized, releasing throttle cable (6) control and the engine stops.

Idle standby select utilizes the same operation as described except that when a normal stop signal is received, idle solenoid (5) is held energized and therefore the engine is held at idle until such time as a start/on signal is received or a fault condition is sensed.

Manual override is by retention of original manual engine controls.

I claim:

1. For an internal combustion engine having a pressurized lube oil system, starter and fuel metering speed control, a remote controllable engine start/stop device providing automatic engine protection fault shutdown, adjustable rate gradual engine speed increase, an adjustable engine warm-up period varied by at least one of engine and ambient temperature, engine load on/off switching, engine idle cool-down prior to stop upon no-fault turn-off select, selectable idle/off standby and manual override, comprising, in combination:

a. an orientation and attachment means, connectable to an engine fuel metering speed control and operatively associated with a fluid actuator to orientation and attachment means coupling means to provide full-range operative movement upon the engine's fuel metering speed control by an electrical to mechanical motion transducer means and a fluid actuator means;

b. a fluid actuator to orientation and attachment means coupling means, operatively associated with said orientation and attachment means, said electrical to mechanical motion transducer means and said fluid actuator means, and arranged to enable said fluid actuator means override of said electrical to mechanical motion transducer means by said actuator to orientation and attachment means coupling means movement to achieve:

(1) reset of engine's fuel metering speed control to off position by said orientation and attachment means upon signal for engine cut off, (2) movement of said orientation and attachment means and therefore the engine's fuel metering speed control, by said electrical to mechanical motion transducer means, to the engine's start/idle position during start/idle mode, and (3) upon the engine's operation above idle speed, said electrical to mechanical motion transducer means inoperative upon said orientation and attachment means with full positioning control asserted by said fluid actuator means;

c. an electrical to mechanical motion transducer means, permitting remote operation and control by engine condition transducers, said electrical to mechanical motion transducer means having movable member means so arranged to act upon and impart motion to said orientation and attachment means, and thereby to the engine's fuel metering speed control, by an electrical signal, between two positions, the first being engine off and the second being idle when the engine's starter is operated and when idle mode is selected;

d. a fluid actuator means, having movable member means operatively associated with said fluid actuator to orientation and attachment means coupling means to provide a range of movement to said fluid actuator to orientation and attachment means coupling means, for actuating the engine's fuel metering speed control from off to operating speed positions by travel of said orientation and attachment means, upon application over time of fluid pressure at said included port means of said fluid actuator means;

e. a stored energy means, including movable member means operatively associated therewith, and arranged to compel return of said orientation and attachment means, upon loss of operating fluid pressure at said fluid actuator means port, to an engine off position;

f. an electrically switched fluid paths means, providing remote operation and control by engine condition transducers, said electrically switched fluid paths means containing and controlling a choice of two fluid pressure path means, the first path means connecting an included in port to an included out port, said out port communicating with said fluid actuator means port as to provide throttle advance, the second path means connecting said included out port to an included drain port whenever throttle-down is signaled;

g. a fluid pressure switched fluid paths means, containing an adjustable orifice means, permitting an adjustable rate of restricted fluid flow in a forward flow direction, and full reverse flow in the opposite direction, said fluid pressure switched fluid paths means having as one path an inlet port means communicating with the engine's pressurized lube oil system so as to allow pressurized fluid travel by way of said included adjustable restricted forward flow path means, through to an included outlet port means in communication with said in port means of said electrically switched fluid paths means, and as the other path said included outlet port means in communication with said in port means of said electrically switched fluid paths means, back to said included inlet port means by way of an included one-way fluid flow means arranged to allow full reverse flow of fluid from said included outlet port means to said included inlet port means whenever fluid pressure present at said included outlet port means is greater than fluid pressure present at said included inlet port means, whereas greater pressure present at said included inlet port means causes said path to be blocked by operation of said included one-way fluid flow means, said included full reverse flow path permitting of movement of apparatus to adjust engine fuel metering speed control to off, upon any engine lube oil pressure loss, regardless of probable malfunction, and thereby decrease reliance on an engine oil pressure fault sensor;

h. a sensor means, operatively associated with said apparatus, to detect and produce a signal at a point of said apparatus travel corresponding to a preselected engine speed, to enable connection and disconnection of engine load; and i. a retaining and mounting means, operatively connected to said apparatus such as to maintain spatial relationship of apparatus elements and concurrently provide means of fastening said apparatus to a surface.

2. For an internal combustion engine having a pressurized lube oil system, starter and fuel metering speed control a remote controllable engine start/stop device providing automatic-engine protection fault shutdown, adjustable rate gradual engine speed increase, an adjustable engine warm-up period varied by at least one of engine and ambient temperature, engine load on/off switching, engine idle cool-down prior to stop upon no-fault turn-off select, selectable idle/off standby and manual override, comprising, in combination:

a. a throttle cable means connectable to an engine's fuel metering speed control and operatively associated with an actuator tube means to provide full-range operative movement upon the engine's fuel metering speed control by an idle solenoid means and a spring-return hydraulic cylinder means;

b. an actuator tube means, operatively associated with said throttle cable means, said idle solenoid means and said spring-return hydraulic cylinder means, and arranged to enable said spring-return hydraulic cylinder means override of said idle solenoid means by said actuator tube means movement to achieve:

(1) reset of the engine's fuel metering speed control to off position by said throttle cable means upon signal for engine cut off, (2) movement of said throttle cable means and therefore the engine's fuel metering speed control by said idle solenoid means, to the engine's start/idle position during start/idle mode, and (3) upon engine operation above idle speed, said idle solenoid means inoperative upon said throttle cable means with full positioning control asserted by said spring-return hydraulic cylinder means;

c. an idle solenoid means, permitting remote operation and control by engine condition transducers, said idle solenoid means having movable member means so arranged to act upon and impart motion to said throttle cable means, and thereby to the engine's fuel metering speed control, by an electrical signal, between two positions, the first being engine off and the second being idle when the engine's starter is operated and when idle mode is selected;

d. a spring-return hydraulic cylinder means, having movable member means operatively associated with said actuator tube means to provide a range of movement to said actuator tube means, for actuating the engine's fuel metering speed control from off to operating speed positions by travel of said throttle cable means, upon application over time of fluid pressure by said included port means of said spring-return hydraulic cylinder means to said included movable member means;

e. a spring means, including movable member means operatively associated therewith, and arranged to compel return of said throttle cable means, upon loss of operating fluid pressure at said spring-return hydraulic cylinder means port, to an engine off position;

f. a solenoid valve means, providing remote operation and control by engine condition transducers, said solenoid valve means containing and controlling a choice of two fluid pressure path means, the first path means connecting an included in port to an included out port, said out port communicating with said spring-return hydraulic cylinder means port as to provide throttle advance, the second path means connecting said included out port to an included drain port whenever throttle-down is signaled;

g. a controlled check valve means, containing an adjustable orifice means, permitting an adjustable rate of restricted fluid flow in a forward flow direction, and full reverse flow in the opposite direction, said controlled check valve means having as one path an inlet port means communicating with the engine's pressurized lube oil system so as to allow pressurized fluid travel by way of said included adjustable restricted forward flow path means, through to an included outlet port means in communication with said in port means of said solenoid valve means, and as the other path said included outlet port means in communication with said in port means of said solenoid valve means, back to said included inlet port means by way of an included one-way fluid flow means arranged to allow full reverse flow of fluid from said included outlet port means to said included inlet port means whenever fluid pressure present at said included outlet port means is greater than fluid pressure present at said included inlet port means, whereas greater pressure present at said included inlet port means causes said path to be blocked by operation of said included one-way fluid flow means, said included full reverse flow path permitting of movement of apparatus to adjust engine fuel metering speed control to off, upon any engine lube oil pressure loss, regardless of probable malfunctions, and thereby decrease reliance on an engine oil pressure fault sensor;

h. a load switch sensor means, operatively associated with said apparatus, to detect and produce a signal at a point of said apparatus travel corresponding to a preselected engine speed, to enable connection and disconnection of engine load;

i. a mount means, operatively connected to said apparatus such as to maintain spatial relationship of apparatus elements, and concurrently provide means of fastening said apparatus to a surface; and j. a guide tube means, operatively associated with said actuator tube means, so as to provide control and stability to said actuator tube means movement and concurrently provide means of assembling solenoid means and spring-return hydraulic cylinder means into apparatus, by operation of guide tube crimp and interference fit of tubing adapter.

3. The apparatus of claim 2 wherein, said load switch sensor means is a frequency detector means in combination with associated circuitry means operatively associated with one of an engine's generator and alternator and arranged to sense frequency directly and thereby provide a signal to enable a load-connect function.

* * * * *